US008544653B2

(12) United States Patent
Kao

(10) Patent No.: US 8,544,653 B2
(45) Date of Patent: Oct. 1, 2013

(54) STORAGE FRAME FOR TOOL RACK ASSEMBLIES

(76) Inventor: Ju-Chien Kao, Taichung (TW)

( * ) Notice: Subject to any disclaimer, the term of this patent is extended or adjusted under 35 U.S.C. 154(b) by 370 days.

(21) Appl. No.: 13/151,037

(22) Filed: Jun. 1, 2011

(65) Prior Publication Data

US 2012/0305438 A1 Dec. 6, 2012

(51) Int. Cl.
*B65D 85/62* (2006.01)

(52) U.S. Cl.
USPC ..... 206/775; 206/485; 211/59.4; 211/85

(58) Field of Classification Search
USPC ..... 206/525, 587, 485, 775, 765, 372, 206/779, 740, 756; 211/59.4, 85, 184; 220/532, 510, 529, 528, 533
See application file for complete search history.

(56) References Cited

U.S. PATENT DOCUMENTS 4,025,039 A * 5/1977 Croll et al. ..... 206/485
4,396,121 A * 8/1983 Lemmon ..... 206/566
4,436,215 A * 3/1984 Kleinert et al. ..... 220/533
6,050,420 A * 4/2000 Green ..... 206/764
7,946,418 B1 * 5/2011 Cerynik ..... 206/362
8,281,927 B2 * 10/2012 Smith ..... 206/485

* cited by examiner

*Primary Examiner* — Mickey Yu
*Assistant Examiner* — Chun Cheung
(74) *Attorney, Agent, or Firm* — patenttm.us

(57) ABSTRACT

A storage frame for tool rack assemblies has a box and multiple rack holders. The rack holders are held between two holding bars in the box. Each rack holder has a board and two clamping devices for holding multiple tool rack assemblies on the board. Each clamping device has a front clamping element and a rear clamping element mounted respectively on two surfaces of the board and connected to each other. The front clamping element has a clamping bar and multiple clamping protrusions formed on and protrude from the clamping bar at a side facing the other clamping bar and are parallel with each other. Accordingly, multiple tool rack assemblies can be held and displayed in the box at a stand condition regularly.

14 Claims, 10 Drawing Sheets

STORAGE FRAME FOR TOOL RACK ASSEMBLIES

BACKGROUND OF THE INVENTION

1. Field of the Invention

The present invention relates to a frame, and more particularly to a storage frame for tool rack assemblies to hold and display tool rack assemblies at a stand condition regularly.

2. Description of the Prior Art

A tool rack assembly is used to hold multiple tools or tool bits and substantially has a rail and multiple hangers. To display tool rack assemblies, the tool rack assemblies are attached onto a board parallelly and are clamped by two clamps to hold the tool rack assemblies regularly and stably on the board to form as a tool rack package.

A conventional storage way for arranging multiple tool rack packages is lying the tool rack packages down and stacking them up. However, the tool rack packages are not easy to be arranged and stacked regularly because the tool rack assemblies are attached on the boards and bulged from the boards.

To overcome the shortcomings, the present invention provides a storage frame for tool rack assemblies to mitigate or obviate the aforementioned problems.

SUMMARY OF THE INVENTION

The main objective of the invention is to provide a storage frame for tool rack assemblies to hold and display tool rack assemblies at a stand condition regularly.

The storage frame for tool rack assemblies has a box and multiple rack holders. The box has two sidewalls, a containing space, an opening top and two holding bars. The containing space has a bottom and two sides respectively adjacent to the sidewalls of the box. The holding bars are mounted respectively at the sides of the bottom of the containing space and are parallel with each other. Each holding bar has multiple holding slots formed in the holding bar at a side facing the other holding bar and respectively aligning with the holding slots in the other holding bar. The rack holders are mounted in the containing space of the box, are held between the holding bars in the box and are respectively securely held between the aligning holding slots in the holding bars. Each rack holder has a board and two clamping devices. The board has a front surface, a rear surface and two side edges respectively inserted into the corresponding holding slots in the holding bars. The clamping devices are mounted respectively adjacent to the side edges of the board for holding multiple tool rack assemblies on the board. Each clamping device has a front clamping element and a rear clamping element. The front clamping element is mounted on the front surface of the board, is adjacent to and parallel with a corresponding side edge of the board and has a clamping bar and multiple clamping protrusions. The clamping bar is elongated, is attached to the front surface of the board and is parallel with the corresponding side edge of the board. The clamping protrusions are formed on and protrude from the clamping bar at a side facing the other clamping bar and are parallel with each other. The rear clamping element is attached to the rear surface of the board and is connected to the front clamping element.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
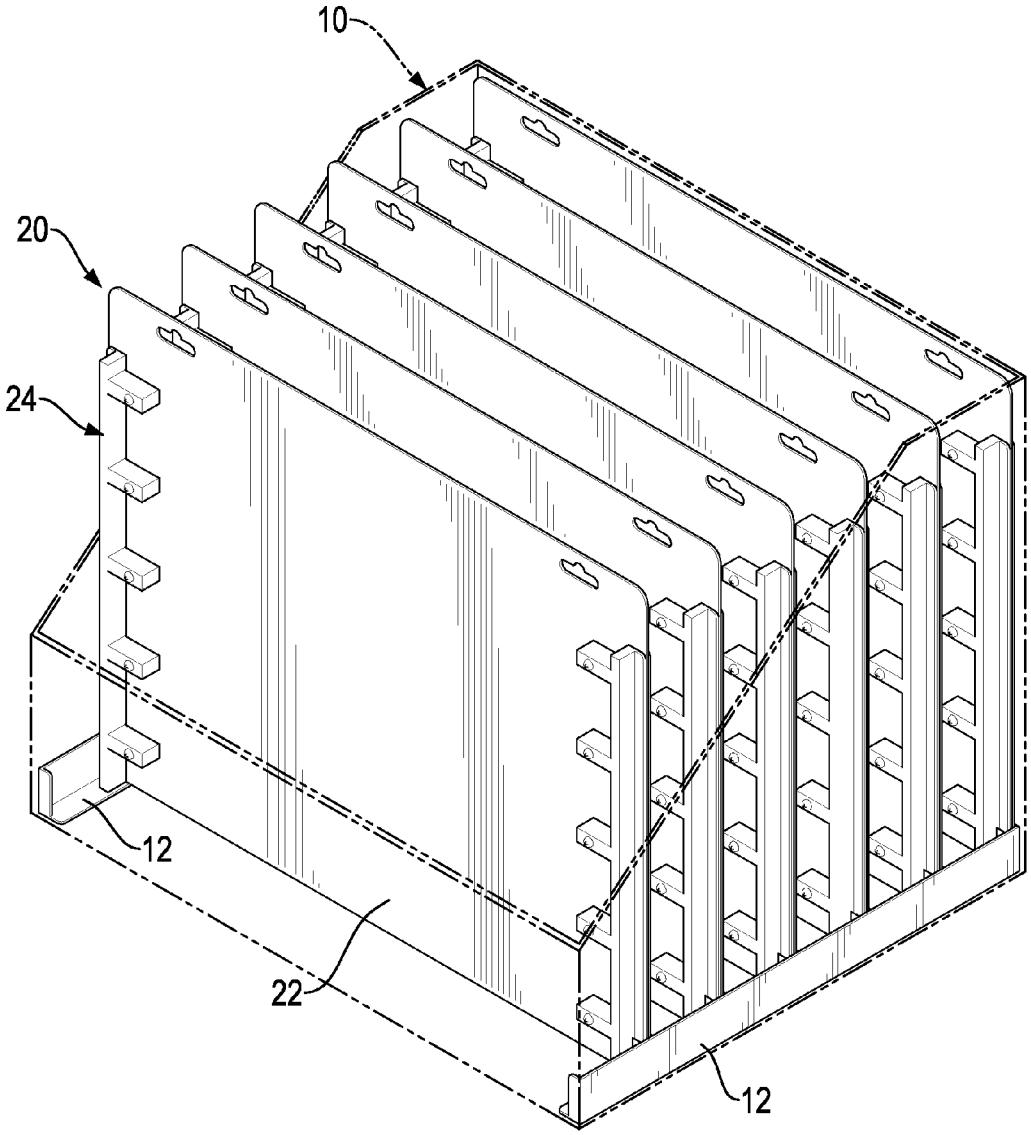
FIG. 1 is a perspective view of a storage frame for tool rack assemblies in accordance with the present invention.
Figure 2:
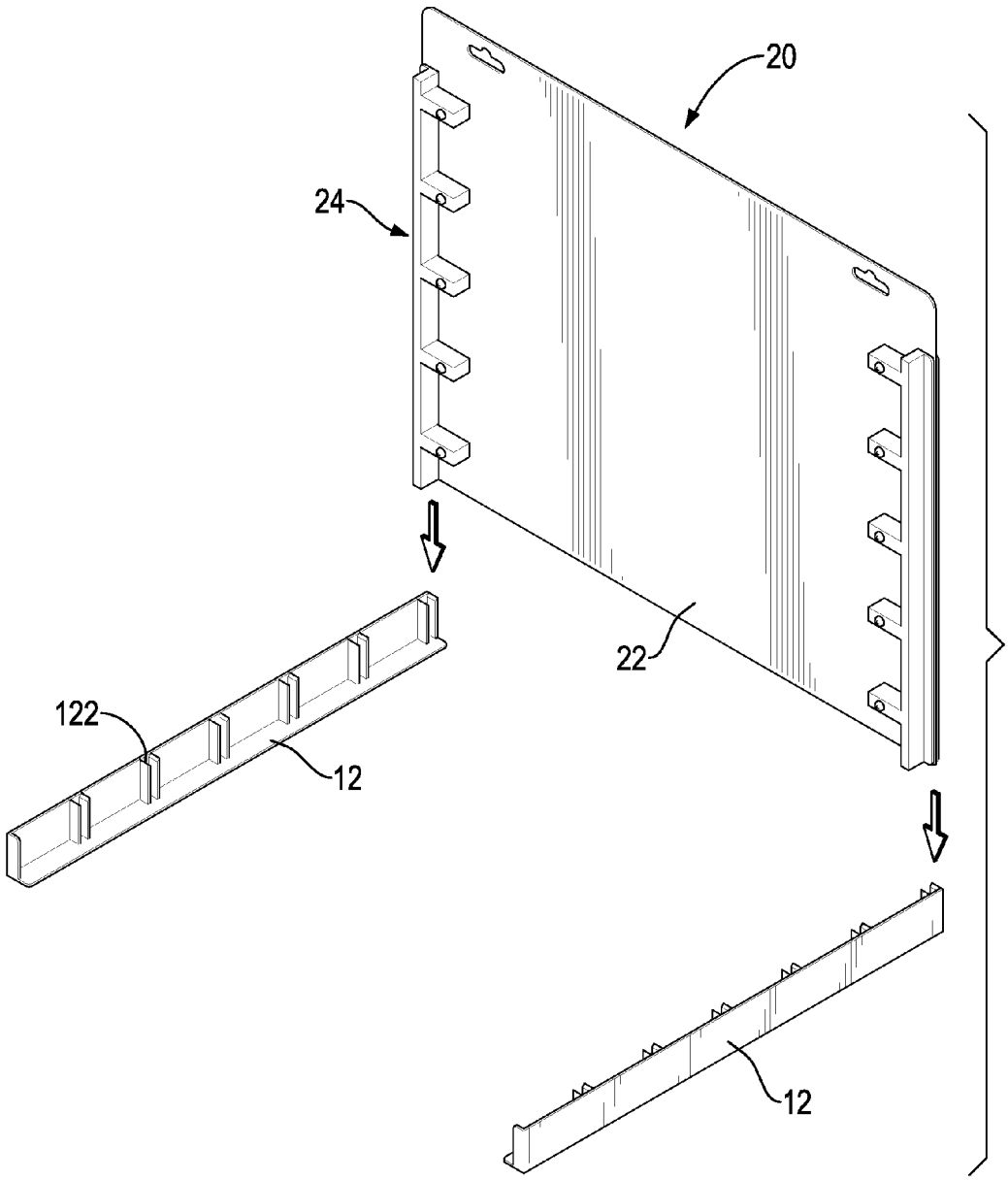
FIG. 2 is a partially exploded perspective view of the storage frame in FIG. 1.
Figure 3:
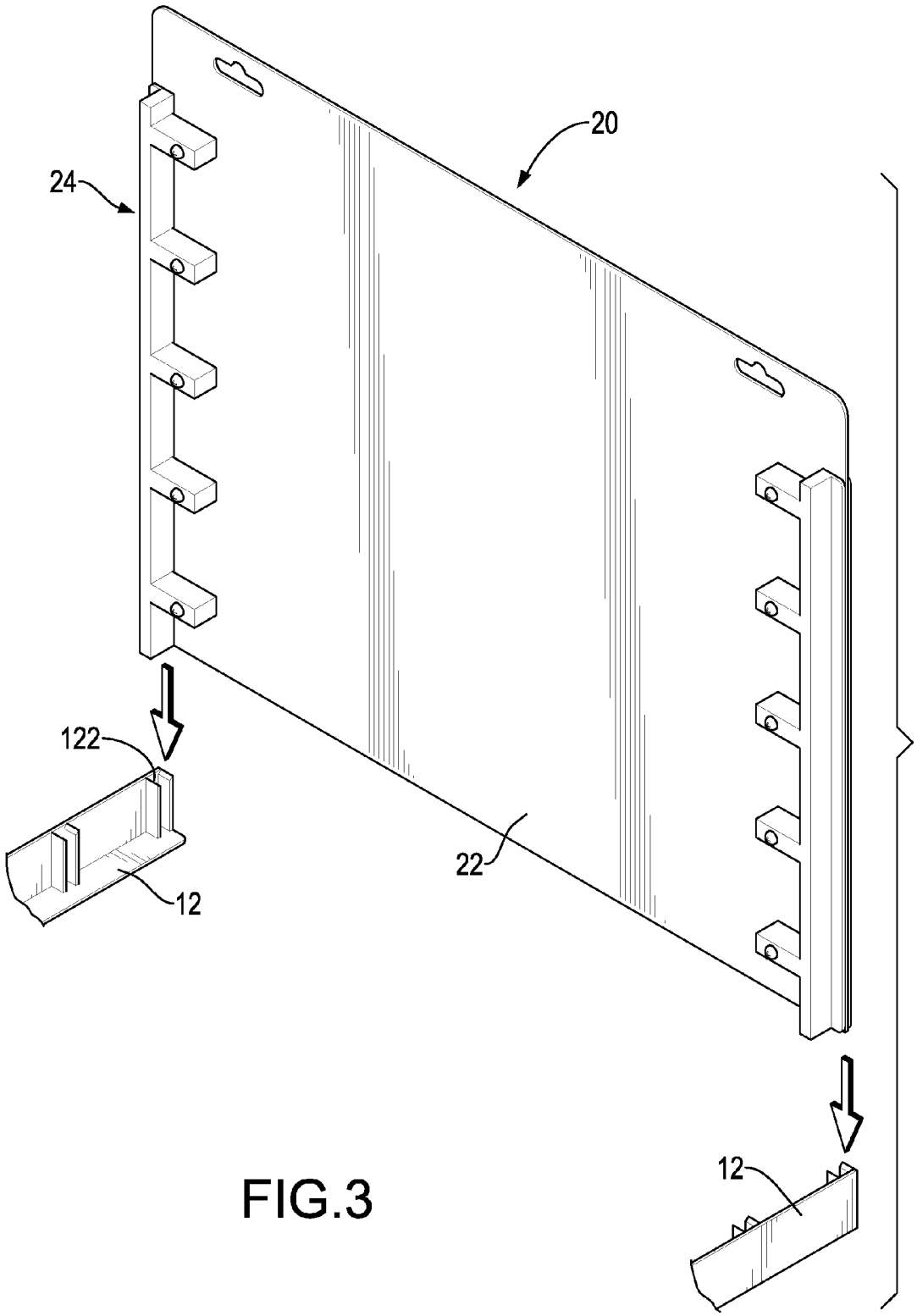
FIG. 3 is an enlarged exploded perspective view of the storage frame in FIG. 2.
Figure 9:
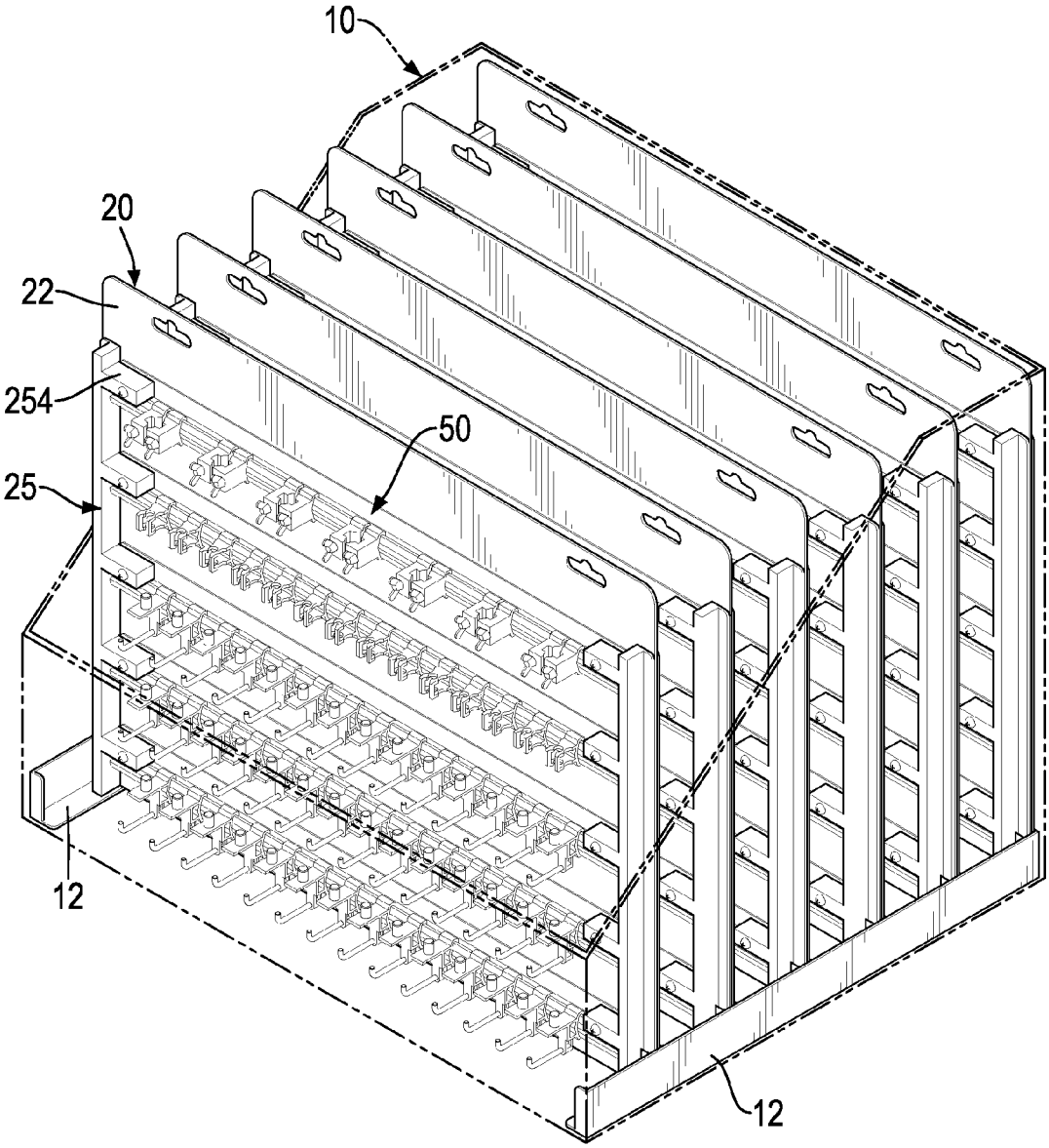
FIG. 9 is an operational perspective view of storage frame in FIG. 1 showing the rack holders with tool rack assemblies being inserted in the box and arranged regularly.

With reference to FIGS. 1 and 9, a storage frame for tool rack assemblies in accordance with the present invention is used in containing tool rack assemblies 50 at a stand condition and has a box 10 and multiple rack holders 20.

The box 10 may be made of paper and has two sidewalls, a containing space, an opening top and two holding bars 12. The containing space has a bottom and two sides respectively adjacent to the sidewalls of the box 10. The holding bars 12 are mounted respectively at two sides of the bottom of the containing space and are parallel with each other. Each holding bar 12 has multiple holding slots 122 formed in the holding bar 12 at a side facing the other holding bar 12 and respectively aligning with the holding slots 122 in the other holding bar 12.

Figure 4:
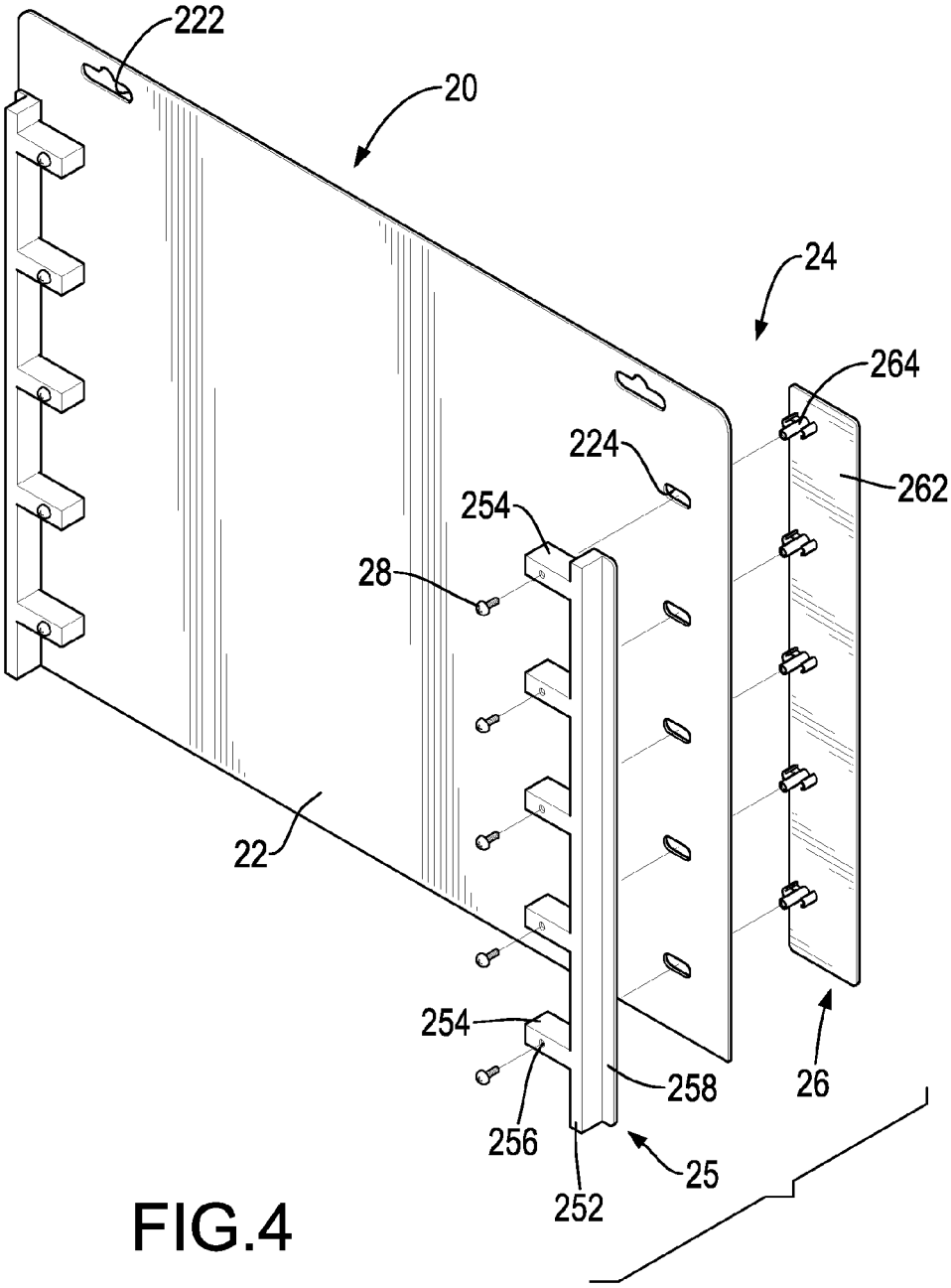
FIG. 4 is a partially exploded perspective view of the rack holder of the storage frame in FIG. 1.
Figure 5:
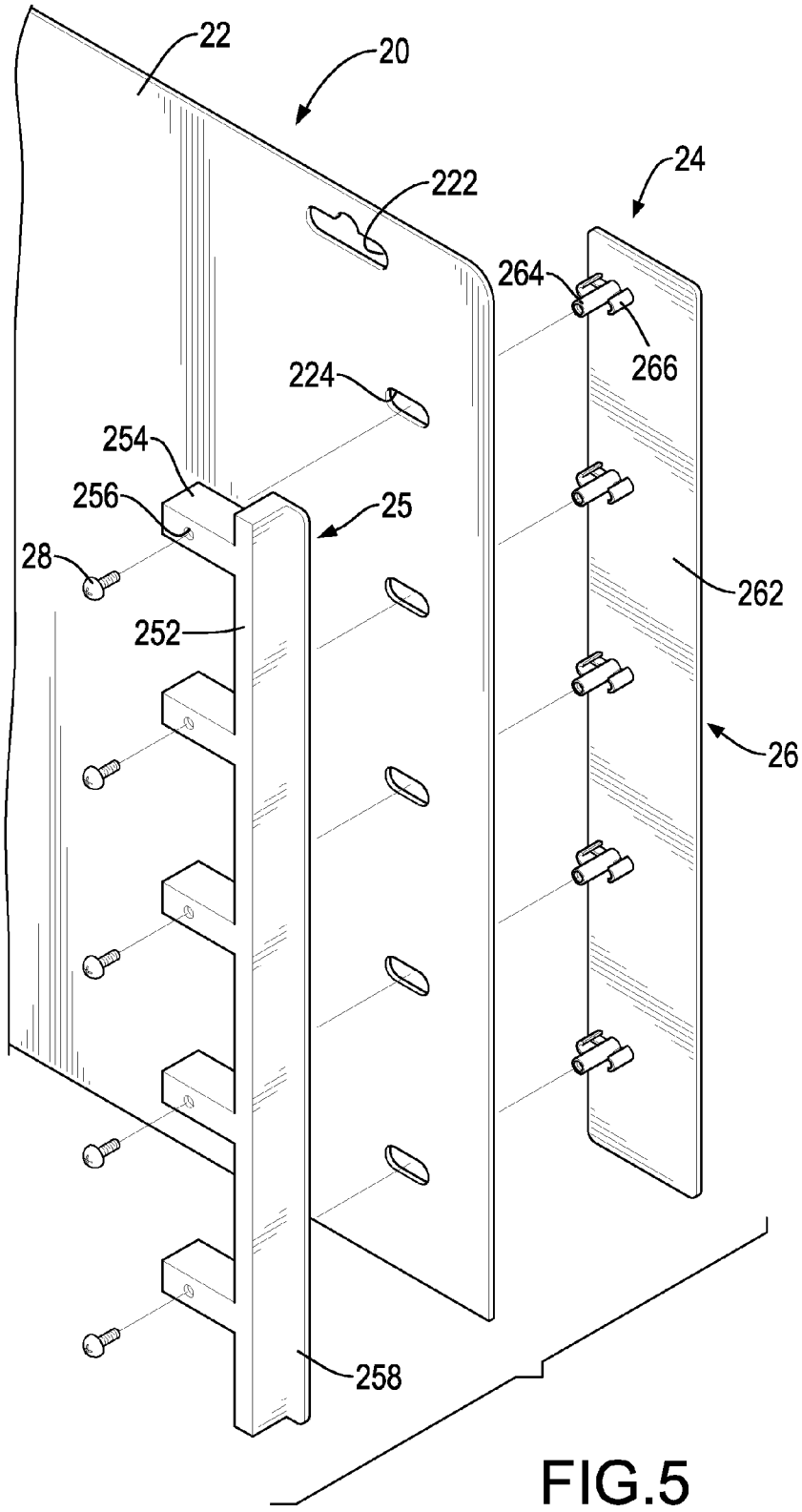
FIG. 5 is an enlarged partially exploded perspective view of the rack holder of the storage frame in FIG. 4.

With further reference to FIGS. 2, 3, 6 and 7, the rack holders 20 are mounted in the containing space of the box 10, are held between the holding bars 12 in the box 10 and are respectively securely held between the aligning holding slots 122 in the holding bars 12. Each rack holder 20 has a board 22 and two clamping devices 24. With further reference to FIGS. 4 and 5, the board 22 has a front surface, a rear surface and two side edges respectively inserted into the corresponding holding slots 122 in the holding bars 12. In addition, the board 22 may further has two hanging holes 222 defined through the board near the top of the board to enable the rack holder 20 to be hung on a wall or the like individually.

Figure 10:
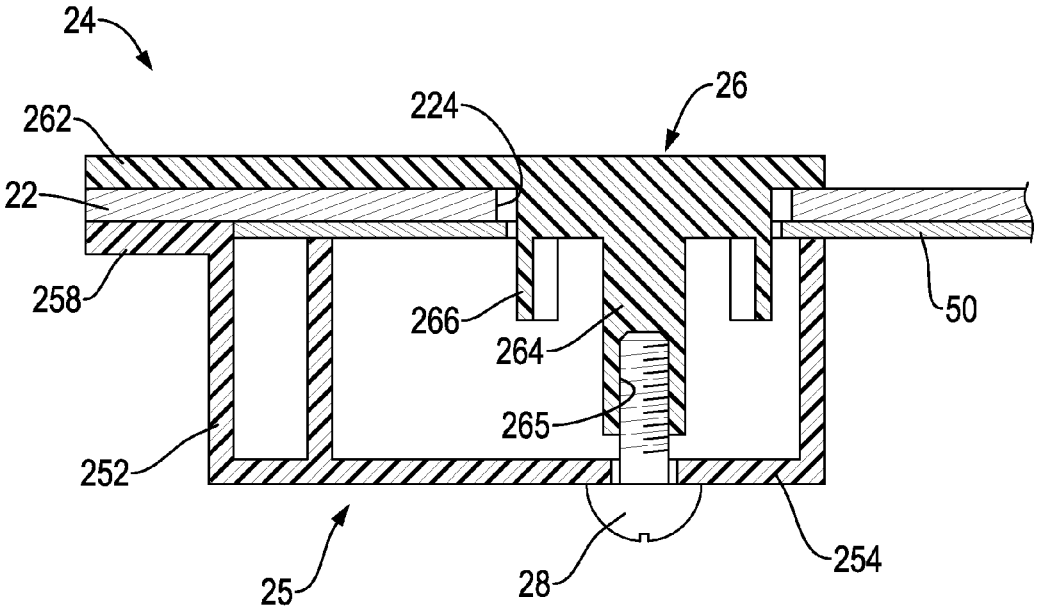
FIG. 10 is an enlarged top view in partial section of the clamping device of the storage frame in FIG. 9.

The clamping devices 24 are mounted respectively adjacent to the side edges of the board 22 for holding multiple tool rack assemblies 50 on the board 22. Each clamping device 24 has a front clamping element 25 and a rear clamping element 26 mounted respectively on the front surface and the rear surface of the board 22 and connected to each other with fasteners. The front clamping element 25 is mounted on the front surface of the board 22, is adjacent to and parallel with a corresponding side edge of the board 22 and comprises an elongated clamping bar 252, multiple clamping protrusions 254 and a holding wing 258. The clamping bar 252 is attached to the front surface of the board 22 and is parallel with the corresponding side edge of the board 22. The clamping protrusions 254 are formed on and protrude from the clamping bar 252 at a side facing the other clamping bar 252, may be perpendicular to the clamping bar 252 and are parallel with each other. With further reference to FIG. 10, each clamping protrusion 254 may be hollow and has a through hole 256 defined through the clamping protrusion 254. The holding wing 258 is formed on and protrudes from the clamping bar 252 at a side opposite to the clamping protrusions 254 and having a free edge being parallel and flush with the corresponding side edge of the board 22.

The rear clamping element 26 is attached to the rear surface of the board 22, is connected to the front clamping element 25 and has a base plate 262, multiple connecting posts 264 and multiple pairs of aligning ears 266. The base plate 262 is attached to the rear surface of the board 22 and is parallel with the corresponding side edge of the board 22. The connecting posts 264 are formed on and protrude from the base plate 262, are mounted through the board 22, are respectively mounted in the hollow clamping protrusions 254 on the front clamping element 25 and are respectively aligned with the through holes 256 in the clamping protrusions 254 on the front clamping element 25. Each connecting post 264 has a threaded hole 265 defined in the connecting post 264 and aligns with the through hole 256 in the corresponding claming protrusion 254. In practice, multiple elongated through holes 224 are formed through the board 22 and are arranged in two lines that are respectively adjacent to and parallel with the side edges of the board 22, and the connecting posts 264 of the rear clamping elements 26 of the clamping devices 24 are mounted respectively through the through holes 224 in the board 22. Multiple bolts 28 are respectively mounted through the through holes 256 in the clamping protrusions 254 and are respectively screwed into the threaded holes 265 in the connecting posts 264, such that the front clamping element 25 and the rear clamping element 26 are connected with each other with the bolts 28.

Each pair of aligning ears 266 is formed on the base plate 262 respectively at two sides of one of the connecting posts 264 and is mounted through a corresponding elongated through hole 224 in the board 22. The aligning ears 266 can provide a guiding and aligning effect while mounting the connecting posts 264 through the elongated through holes 224 in the board 22.

Figure 6:
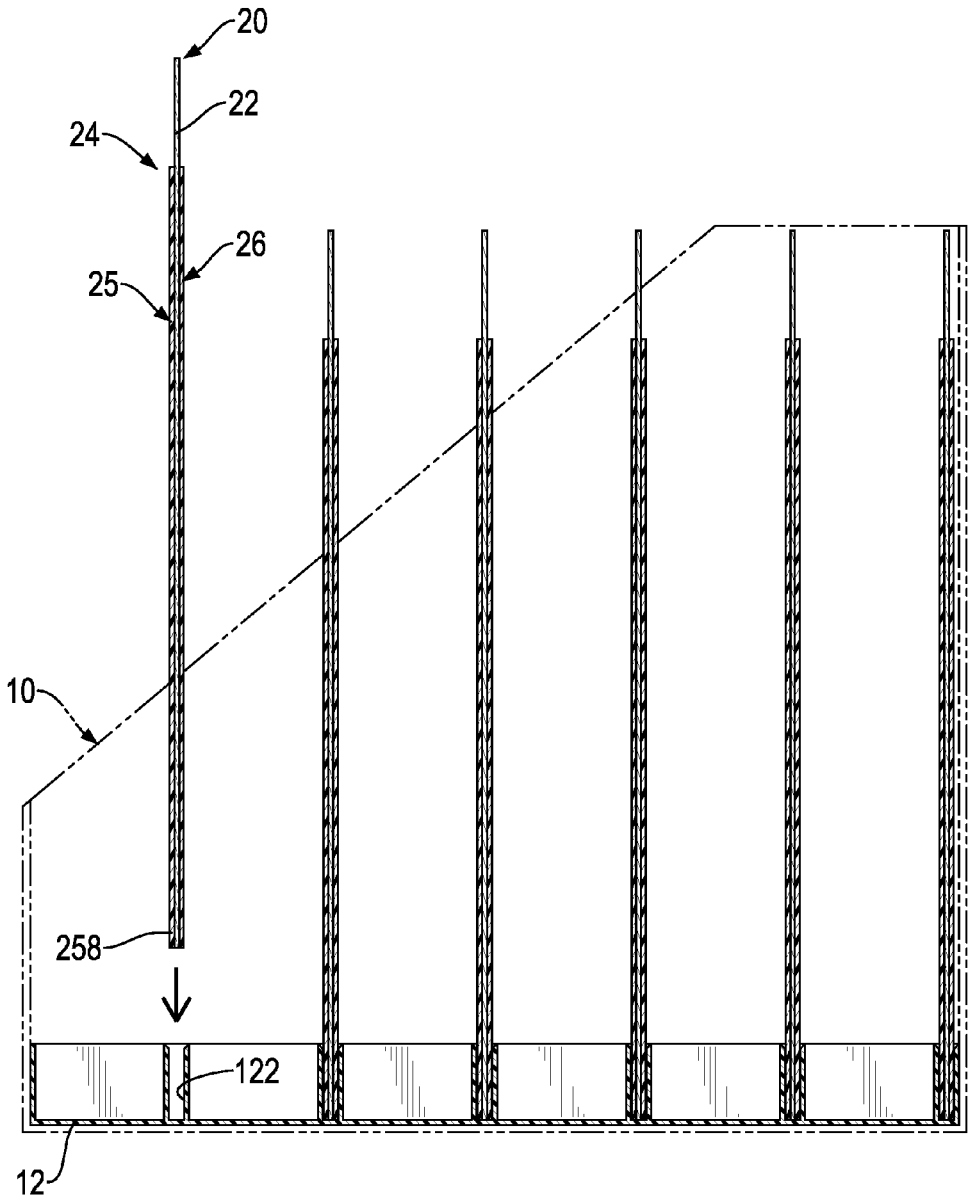
FIG. 6 is an operational cross sectional side view of the storage frame in FIG. 1 showing the rack holders being inserted into the box.
Figure 7:
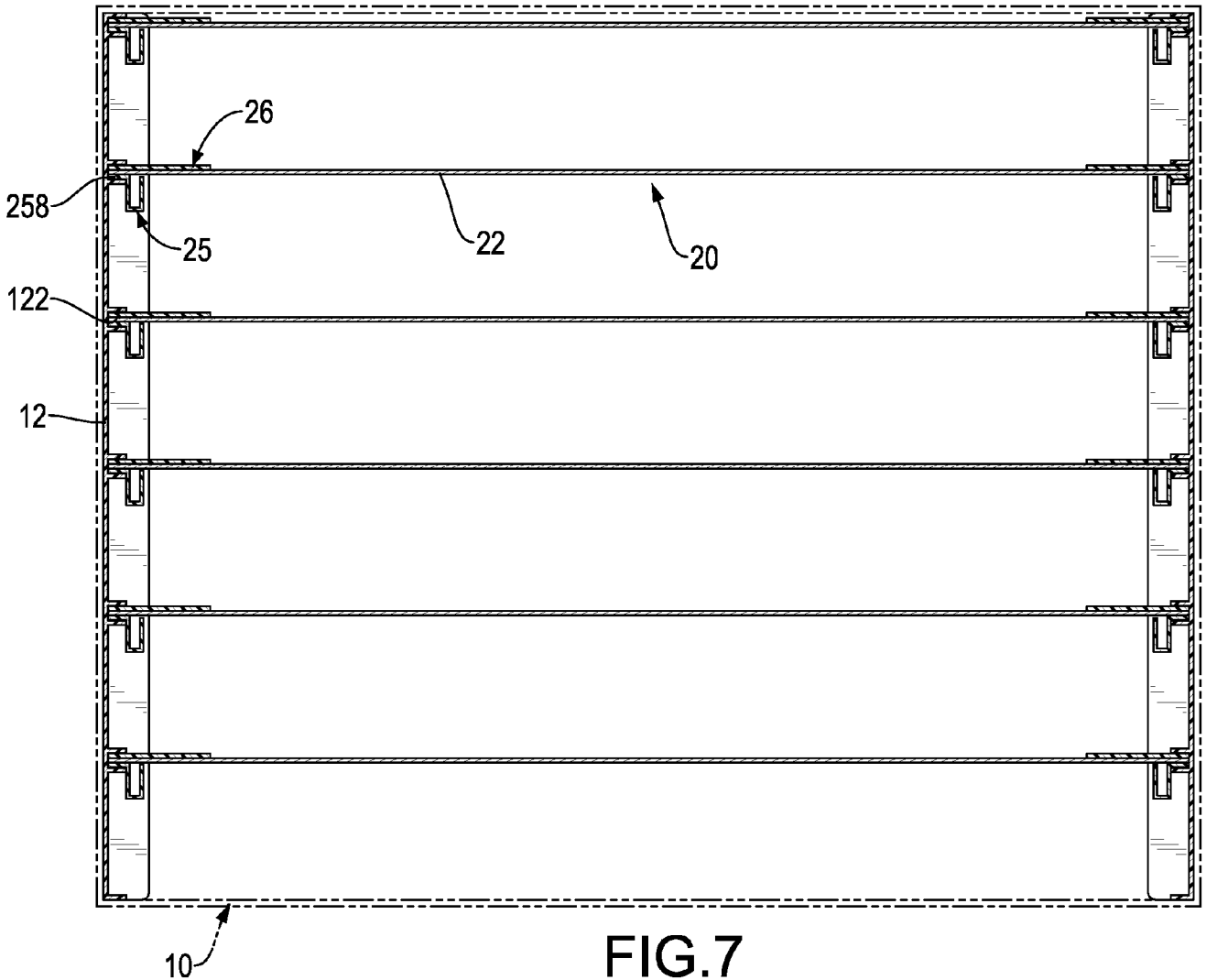
FIG. 7 is a cross sectional top view of the storage frame in FIG. 1.
Figure 8:
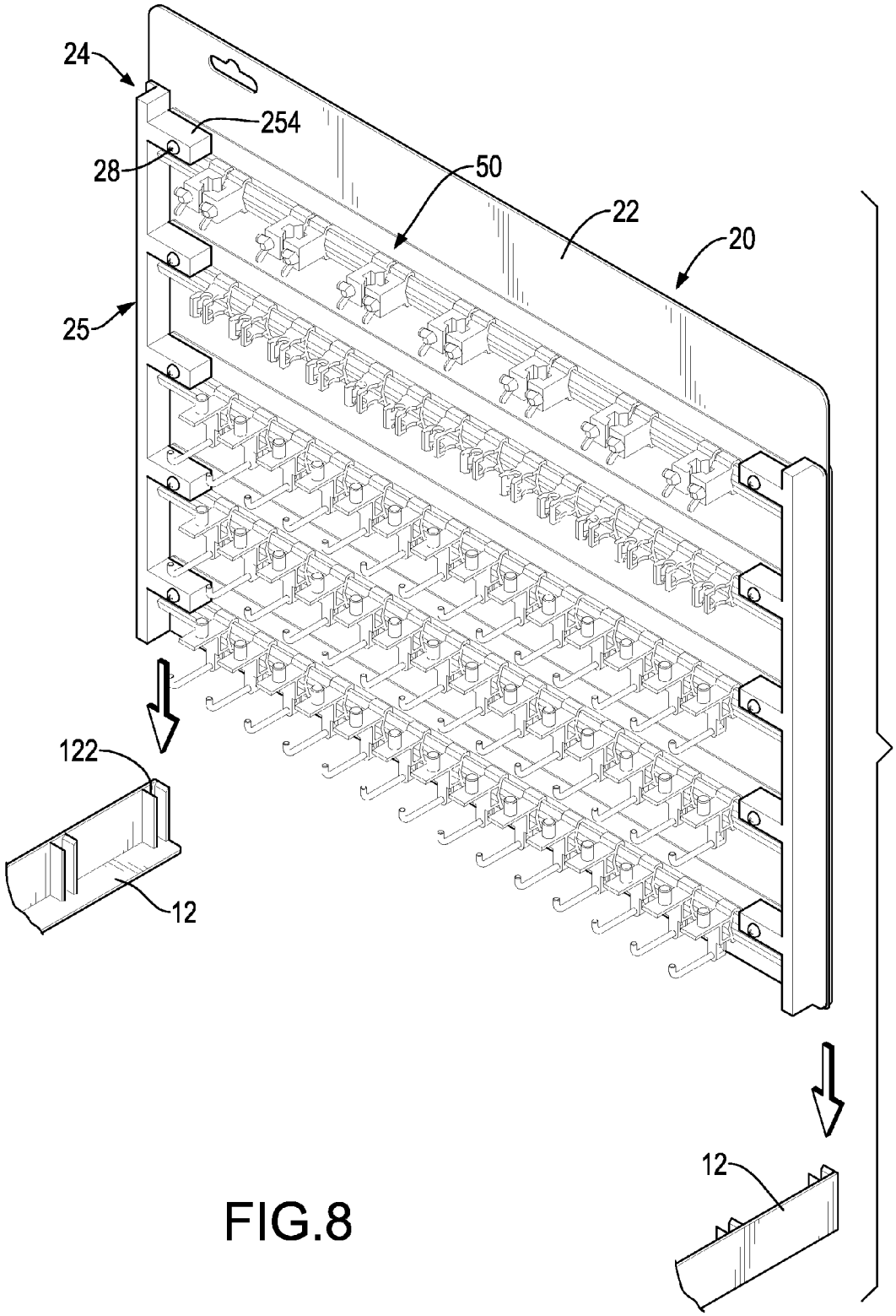
FIG. 8 is an enlarged exploded operational perspective view of the storage frame in FIG. 1 showing the rack holder with multiple tool rack assemblies being inserted in the box.

In use, with reference to FIGS. 8 to 10, multiple tool rack assemblies 50 are attached to the front surface of the board 22, and the front clamping elements 25 and the rear clamping elements 26 are respectively attached to the front surface and the rear surface of the board 22 and are connected with each other with the bolts 28 to make the clamping protrusions 254 attach onto the racks of the tool rack assembles 50. Accordingly, the tool rack assemblies 50 can be securely clamped between the front clamping elements 25 and the board 22 and be held on the board 22 to form as a tool rack package. In practice, the aligning ears 266 on the rear clamping elements 26 are also mounted through the hanging holes in the tool rack assemblies 50. Consequently, the side edges of the board 22 are then inserted into the aligning holding slots 122 in the holding bars 12 of the box 10, such that the board 22 can be held in the box 10 and clamped between the holding bars 12 at a stand condition. Preferably, the free edges of the holding wings 258 of the front clamping elements 25 and edges of the base plates 262 of the rear clamping elements 26 are also inserted into the aligning holding slots 12 in the holding bars 10 as shown in FIGS. 6 and 7. Alternatively, if the holding wings 258 are not implemented on the front clamping elements 25, only the side edges of the board 22 or the side edges of the board 22 with the edges of the base plates 262 of the rear clamping elements 26 are inserted into the aligning holding slots 122 in the holding bars 12. Accordingly, multiple rack holders 20 with tool rack assemblies 50 can be held in the box 10 between the holding bars 12 parallelly, such that multiple tool rack packages 50 can be arranged regularly and displayed clearly in the box 10. In addition, the clamping devices 24 also provide a burglarproofing effect to prevent the tool rack assemblies 50 from being taken away arbitrarily.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A storage frame for tool rack assemblies comprising
- a box having
  - two sidewalls;
  - a containing space having a bottom and two sides respectively adjacent to the sidewalls of the box;
  - an opening top; and
  - two holding bars mounted respectively at the sides of the bottom of the containing space and being parallel with each other, and each holding bar having multiple holding slots formed in the holding bar at a side facing the other holding bar and respectively aligning with the holding slots in the other holding bar; and
- multiple rack holders mounted in the containing space of the box, held between the holding bars in the box and respectively securely held between the aligning holding slots in the holding bars, and each rack holder having
  - a board having a front surface, a rear surface and two side edges respectively inserted into the corresponding holding slots in the holding bars; and
  - two clamping devices mounted respectively adjacent to the side edges of the board for holding multiple tool rack assemblies on the board, and each clamping device having
    - a front clamping element mounted on the front surface of the board, being adjacent to and parallel with a corresponding side edge of the board and comprising
      - an elongated clamping bar attached to the front surface of the board and being parallel with the corresponding side edge of the board; and
      - multiple clamping protrusions formed on and protruding from the clamping bar at a side facing the other clamping bar and being parallel with each other; and
    - a rear clamping element attached to the rear surface of the board and connected to the front clamping element.

2. The storage frame as claimed in claim 1, wherein
- each clamping protrusion is hollow and has a through hole defined through the clamping protrusion;
- the rear clamping element of each clamping device comprises
  - a base plate attached to the rear surface of the board and being parallel with the corresponding side edge of the board; and
  - multiple connecting posts formed on and protruding from the base plate, mounted through the board, respectively mounted in the hollow clamping protrusions on the front clamping element of the claming device and respectively aligned with the through holes in the clamping protrusions on the front clamping element of the claming device, and each connecting post having a threaded hole defined in the connecting post and aligning with the through hole in a corresponding claming protrusion; and multiple bolts are respectively mounted through the through holes in the clamping protrusions of the clamping devices and are respectively screwed into the threaded holes in the connecting posts to connect the front clamping element and the rear clamping element with each other.

3. The storage frame as claimed in claim 2, wherein the front clamping element of each clamping device further has a holding wing formed on and protruding from the clamping bar of the front clamping element at a side opposite to the clamping protrusions and having a free edge being parallel and flush with the corresponding side edge of the board.

4. The storage frame as claimed in claim 3, wherein the clamping protrusions of the front clamping element of each clamping device are perpendicular to the clamping bar of the front clamping element of the claming device.

5. The storage frame as claimed in claim 4, wherein the board of each rack holder further has multiple elongated through holes formed through the board and arranged in two lines that are respectively adjacent to and parallel with the side edges of the board; and the connecting posts of the rear clamping elements of the clamping devices are mounted respectively through the through holes in the board.

6. The storage frame as claimed in claim 5, wherein the rear clamping element of each clamping device further have multiple pair of aligning ears formed on the base plate, and each pair of aligning ears is respectively at two sides of one of the connecting posts and is mounted through a corresponding elongated through hole in the board.

7. The storage frame as claimed in claim 6, wherein the board of each rack holder further has two hanging holes defined through the board near a top of the board.

8. The storage frame as claimed in claim 7, wherein the box is made of paper.

9. The storage frame as claimed in claim 2, wherein the board of each rack holder further has multiple elongated through holes formed through the board and arranged in two lines that are respectively adjacent to and parallel with the side edges of the board; and the connecting posts of the rear clamping elements of the clamping devices are mounted respectively through the through holes in the board.

10. The storage frame as claimed in claim 9, wherein the rear clamping element of each clamping device further have multiple pair of aligning ears formed on the base plate, and each pair of aligning ears is respectively at two sides of one of the connecting posts and is mounted through a corresponding elongated through hole in the board.

11. The storage frame as claimed in claim 1, wherein the front clamping element of each clamping device further has a holding wing formed on and protruding from the clamping bar of the front clamping element at a side opposite to the clamping protrusions and having a free edge being parallel and flush with the corresponding side edge of the board.

12. The storage frame as claimed in claim 1, wherein the clamping protrusions of the front clamping element of each clamping device are perpendicular to the clamping bar of the front clamping element of the claming device.

13. The storage frame as claimed in claim 1, wherein the board of each rack holder further has two hanging holes defined through the board near a top of the board.

14. The storage frame as claimed in claim 1, wherein the box is made of paper.

* * * * *